US007901238B1

(12) United States Patent
Muir et al.

(10) Patent No.: US 7,901,238 B1
(45) Date of Patent: Mar. 8, 2011

(54) TERMINAL BLOCK AND BOARD ASSEMBLY FOR AN ELECTRICAL CONNECTOR

(75) Inventors: Sheldon Easton Muir, Whitsett, NC (US); Paul John Pepe, Clemmons, NC (US); Ralph Sykes Martin, Mount Airy, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/540,955

(22) Filed: Aug. 13, 2009

(51) Int. Cl.
*H01R 4/24* (2006.01)

(52) U.S. Cl. ..... 439/417; 439/76.1

(58) Field of Classification Search ..... 439/701, 439/941, 752.5, 65, 417–418, 404–405, 607.09, 439/731
See application file for complete search history.

(56) References Cited

U.S. PATENT DOCUMENTS

| | | | | |
|---|---|---|---|---|
| 4,352,537 | A | 10/1982 | Guelden | |
| 4,915,645 | A | 4/1990 | Könnemann et al. | |
| 5,118,310 | A | 6/1992 | Stroede et al. | |
| 5,695,361 | A * | 12/1997 | Elisei | 439/535 |
| 5,951,321 | A * | 9/1999 | Jaag | 439/405 |
| 6,045,391 | A | 4/2000 | Jaag | |
| 6,050,845 | A | 4/2000 | Smalley, Jr. et al. | |
| 6,338,643 | B1 | 1/2002 | Miller et al. | |
| 6,579,115 | B2 | 6/2003 | Mitsugi | |
| 6,582,255 | B2 | 6/2003 | Simmons et al. | |
| 6,743,042 | B2 | 6/2004 | Kölle et al. | |
| 6,758,695 | B2 | 7/2004 | Pepe et al. | |
| 6,966,793 | B2 * | 11/2005 | Brekosky et al. | 439/417 |
| 7,114,985 | B2 * | 10/2006 | Doorhy et al. | 439/404 |
| 7,175,476 | B2 * | 2/2007 | Kim et al. | 439/620.11 |
| 2008/0182431 | A1 * | 7/2008 | Evans | 439/65 |
| 2009/0035996 | A1 | 2/2009 | Milette et al. | |

FOREIGN PATENT DOCUMENTS

| | | |
|---|---|---|
| DE | 198 23 647 C1 | 9/1999 |
| EP | 358404 A2 | 3/1990 |
| EP | 0 700 126 A1 | 3/1996 |
| WO | WO 96/01510 | 1/1996 |
| WO | WO 97/23020 | 6/1997 |

OTHER PUBLICATIONS

International Search Report, International Application No. PCT/US2010/002196, International Filing Date Oct. 8, 2010.

* cited by examiner

*Primary Examiner* — Michael C Zarroli

(57) ABSTRACT

A terminal block for electrically coupling conductors and terminal contacts. The terminal block includes a terminal base portion that has a mounting side configured to be mounted to a surface of an electrical component. The base portion has contact slots that extend from the mounting side therethrough. The contact slots are configured to receive terminal contacts that are electrically coupled to the electrical component. The terminal block also includes an organizer portion that extends from the base portion and includes channels that extend substantially parallel to the surface of the electrical component. The channels are configured to receive corresponding conductors. The contact slots of the base portion align with corresponding channels of the organizer portion so that the terminal contacts electrically couple the conductors.

20 Claims, 10 Drawing Sheets

TERMINAL BLOCK AND BOARD ASSEMBLY FOR AN ELECTRICAL CONNECTOR

BACKGROUND OF THE INVENTION

The subject matter herein relates generally to electrical connectors, and more particularly, to modular connectors that receive and facilitate interconnecting a plurality of differential pairs.

Multi-port or high-density modular connectors, such as RJ-21 connectors, receive and interconnect numerous differential pairs. For example, a cable holding several twisted pairs may couple to a loading end of the modular connector. The conductors from the twisted pairs are separated from each other within an interior of the modular connector and electrically coupled to contacts therein. The contacts generally extend to a mating end of the modular connector and form a predetermined array of pins. The pins are then mated with corresponding contacts or beams in another electrical connector.

More specifically, known modular connectors electrically couple the conductors of the twisted pairs to corresponding contacts within the interior by soldering a terminal of each conductor to the corresponding contact. However, soldering the conductors to the contacts may be costly and time-consuming, especially when the modular connector is a high-density connector. High-density connectors may have fifty (50) or more contacts that are each soldered to a terminal end of a conductor. Furthermore, modular connectors that solder the terminals and contacts together may have limited capabilities with respect to tuning the performance (e.g., compensating crosstalk or return loss) within the interior of the modular connector.

Accordingly, there is a need for a high-density modular connector that provides an easier and less expensive method of assembling compared to known methods. Furthermore, there is a need for alternative configurations for arranging the conductors within an interior of a modular connector.

BRIEF DESCRIPTION OF THE INVENTION

In one embodiment, a terminal block for electrically coupling conductors and terminal contacts is provided. The terminal block includes a terminal base portion that has a mounting side configured to be mounted to a surface of an electrical component. The base portion has contact slots that extend from the mounting side therethrough. The contact slots are configured to receive terminal contacts that are electrically coupled to the electrical component. The terminal block also includes an organizer portion that extends from the base portion and includes channels that extend substantially parallel to the surface of the electrical component. The channels are configured to receive corresponding conductors. The contact slots of the base portion align with corresponding channels of the organizer portion so that the terminal contacts electrically couple the conductors.

In another embodiment, a board assembly for an electrical connector or device is provided. The board assembly includes a circuit board and terminal contacts that are electrically coupled to the circuit board. The board assembly also includes a terminal block that is mounted on the circuit board. The terminal block includes a terminal base portion that has a mounting side configured to be mounted to a surface of the circuit board. The base portion has contact slots that extend from the mounting side therethrough. The contact slots are configured to receive terminal contacts that are electrically coupled to the circuit board. The terminal block also includes an organizer portion that extends from the base portion and includes channels that extend substantially parallel to the surface of the circuit board. The channels are configured to receive corresponding conductors. The contact slots of the base portion align with corresponding channels of the organizer portion so that the terminal contacts electrically couple the conductors.

In yet another embodiment, an electrical connector is provided that includes a housing that has an interior and a mating end, a loading end, and a longitudinal axis extending therebetween. The connector also includes a circuit board positioned within the housing and terminal contacts that are electrically coupled to the circuit board. The connector also includes a pair of terminal blocks mounted onto the circuit board and separated by a spacing. Each terminal block includes a loading side having openings to channels that extend through the terminal block. The channels are configured to receive conductors inserted into the interior of the housing. The spacing is sized to allow numerous conductors to extend therethrough. The loading sides of the terminal blocks extend along the longitudinal axis and face each other across the spacing.

DETAILED DESCRIPTION OF THE INVENTION

Figure 1:
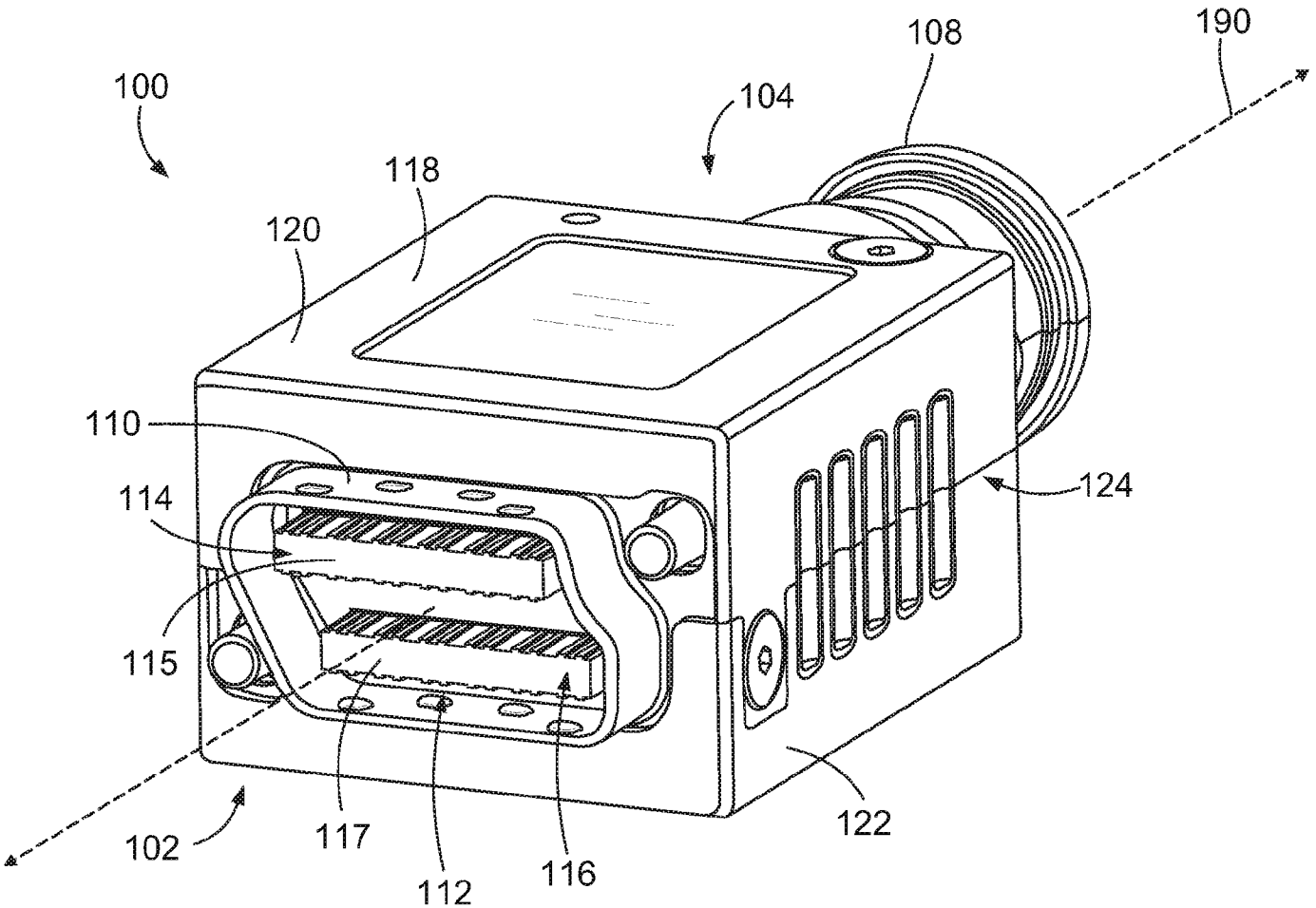
FIG. 1 is a perspective view of an electrical connector formed in accordance with one embodiment.

FIG. 1 is a perspective view of an electrical connector 100 formed in accordance with one embodiment. The connector 100 has a mating end 102, a loading end 104, and a central axis 190 extending between the mating and loading ends 102 and 104. The connector 100 also includes a cable boot 108 that is coupled to the loading end 104 and configured to receive a cable (not shown) of conductors. The conductors may be, for example, twisted differential pair conductors, differential pair conductors with a common mode or ground conductor, single conductors, and the like. The mating end 102 is configured to engage a mating connector (not shown) and includes a shroud 110 that defines a cavity 112 where circuit boards 114 and 116 are positioned to engage the mating connector. The circuit boards 114 and 116 may have contacts or pads at mating ends 115 and 117, respectively, that are configured to mate with contact beams or pads of the mating connector. However, in alternative embodiments, the connector 100 may have pin contacts or socket contacts within the mating cavity that are configured to engage corresponding contacts within the mating connector.

The connector 100 also includes a housing 118 that includes housing shells 120 and 122 that mate along an interface 124 to surround an interior of the connector 100. In the illustrated embodiment, the connector 100 is a modular plug connector, however, the connector 100 may also be a receptacle connector or another type of connector. Furthermore, the connector 100 may be a high-density connector, such as a GbE RJ45 or RJ21 connector, that receives and electrical interconnects numerous conductors. As used herein, "a plurality" means more than one and "numerous conductors" or "numerous differential pairs" means more than 8 conductors and/or 4 differential pairs. For example, the connector 100 may receive and interconnect fifty (50) conductors and arrange them into 6 ports. Furthermore, the connector 100 may satisfy certain industry standards, such as Category 5, 6, 6a, or 7 standards, and operate at frequencies up to 500 MHz or higher. However, embodiments of the connector 100 are not limited to the above types of connectors and benefits of the features described herein may be used by other types of electrical connectors. Furthermore, electrical current transmitted by the connector 100 may be at least one of data signals and electrical power.

Figure 2:
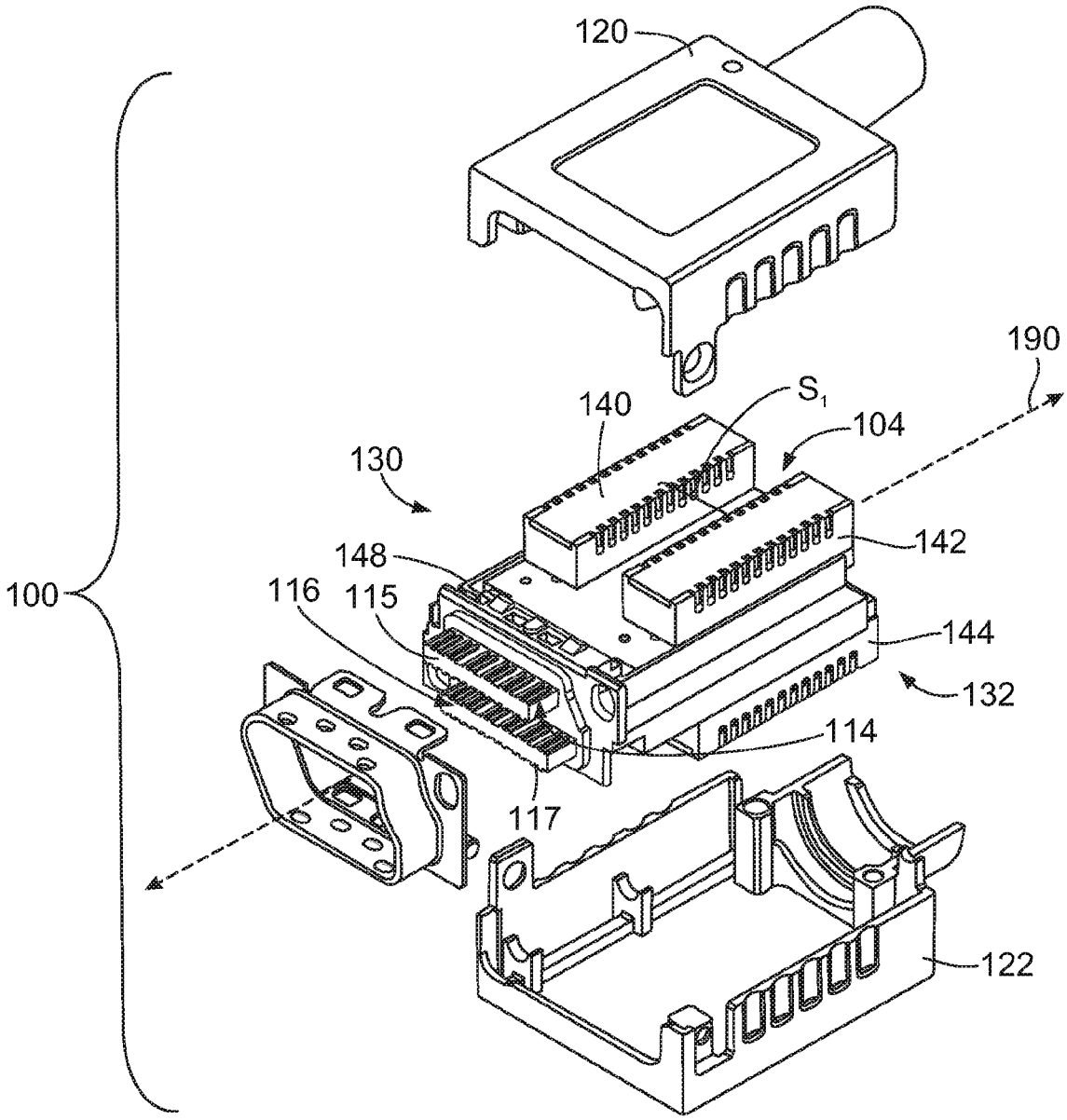
FIG. 2 is a partially exploded view of the connector shown in FIG. 1.

FIG. 2 is a partially exploded view of the connector 100. As shown, the connector 100 includes a pair of board assemblies 130 and 132 that are configured to be enclosed by the housing shells 120 and 122 (i.e., within the interior of the connector 100) when the connector 100 is fully assembled. The housing shells 120 and 122 may be manufactured (e.g., die-cast) from a metal material or a nonconductive material. As shown, the board assembly 130 includes the circuit board 114 and a pair of shielded terminal blocks 140 and 142 mounted to the circuit board 114, and the board assembly 132 includes the circuit board 116 and a shielded terminal block 144 mounted thereto. (Although not shown, the board assembly 132 may also include another terminal block mounted thereto.) In alternative embodiments, the board assemblies 130 and 132 may have only one or more than two terminal blocks mounted to each other. Furthermore, in alternative embodiments, the circuit boards 114 and 116 may sandwich one or more terminal blocks between the circuit boards 114 and 116. The sandwiched terminal block(s) may be mounted or electrically connected to both circuit boards 114 and 116.

The terminal blocks 140 and 142 may be located proximate to the loading end 104 and extend parallel to or along the central axis 190. As shown, the terminal blocks 140 and 142 may be separated or spaced apart from each other by a spacing $S_1$. Also shown, the board assemblies 130 and 132 may be held side-by-side (e.g., stacked) by a board frame 148. The circuit boards 114 and 116 may also be staggered so that the mating ends 115 and 117 are not aligned with each other.

Figure 3:
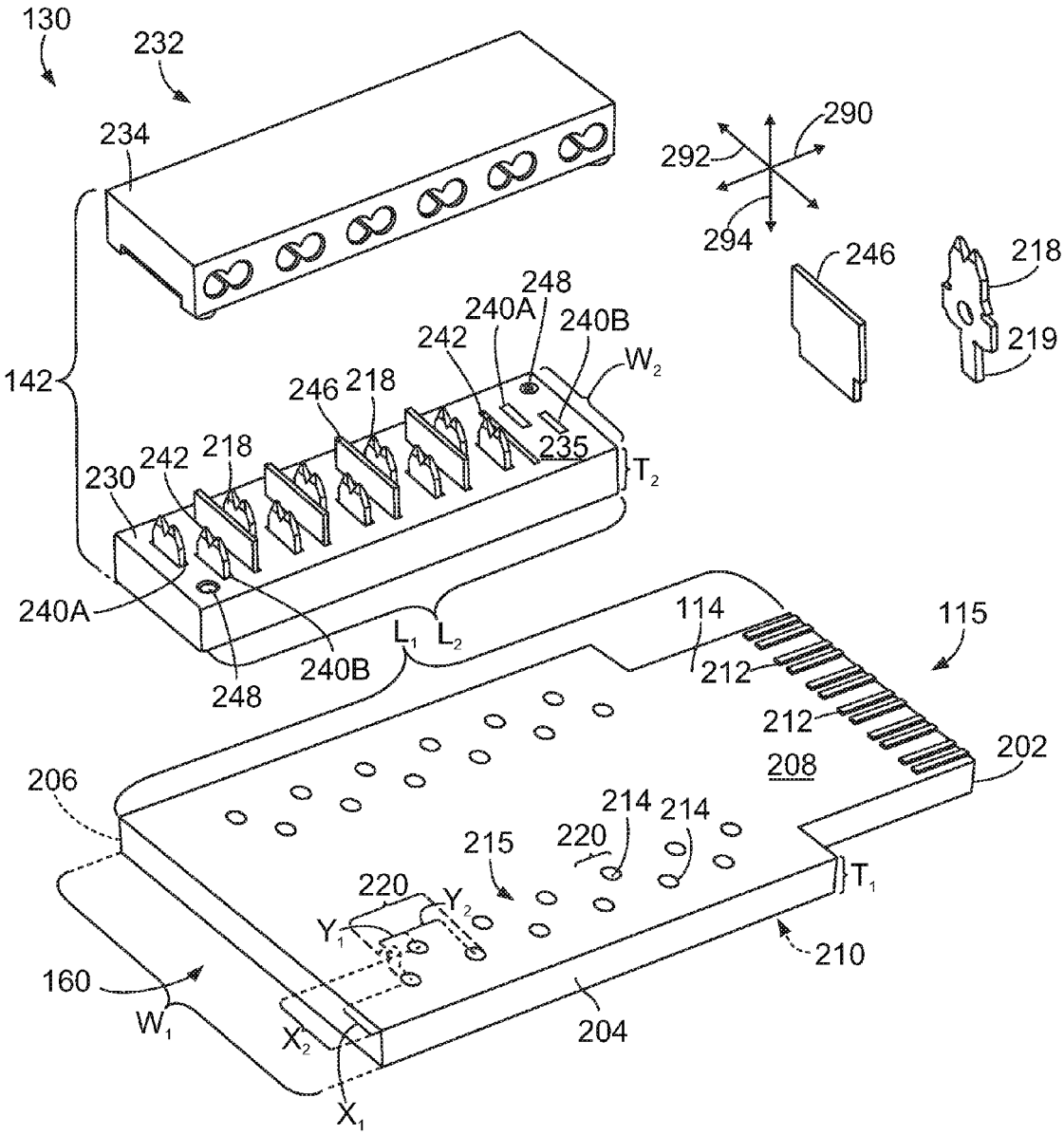
FIG. 3 is an exploded perspective view of a board assembly having a terminal block that is formed in accordance with an embodiment.

FIG. 3 is a rear exploded perspective view of the board assembly 130 and is shown with reference to a longitudinal axis 290, a lateral axis 292, and a vertical axis 294. In the illustrated embodiment, the longitudinal axis 290 extends parallel to the central axis 190 (FIG. 1) of the connector 100 (FIG. 1). As shown, the circuit board 114 has a length $L_1$ that extends between a loading end 160 and the mating end 115 and a width $W_1$ that extends between a pair of side edges 204 and 206. The circuit board 114 also has opposing board surfaces 208 and 210 with a thickness $T_1$ of the circuit board 114 extending therebetween. Although the circuit board 114 is shown as being substantially rectangular, the circuit board 114 may have other shapes in alternative embodiments.

As shown, the circuit board 114 has an array 215 of plated thru-holes or vias 214 that are configured to receive and electrically engage terminal contacts 218. The array 215 may be configured to achieve a desired performance for the connector 100. For example, moving from the loading end 160 to the mating end 115, the vias 214 may be staggered with respect to each other such that the vias 214 alternate between a first lateral distance $X_1$ and a second lateral distance $X_2$ away from the side edge 204. Furthermore, the vias 214 may be grouped in pairs 220. The vias 214 of one pair 220 may be separated from each other by a longitudinal distance $Y_1$ and adjacent vias 214 of different pairs 220 may be separated from each other by a longitudinal distance of $Y_2$. The distances $X_1$, $X_2$, $Y_1$, and $Y_2$ may be configured to achieve a desired performance for the connector 100. However, the array 215 of vias 214 may have different configurations. For example, in an alternative embodiment, the vias 214 may be located on the circuit board 114 widthwise (i.e., along the lateral axis 292). The vias 214 may have other arrangements in order to achieve a desired performance. For example, the vias 214 may be arranged in rows and columns.

The mating end 115 includes a mating edge 202 having a plurality of pads 212 that are located proximate thereto and on both surfaces 208 and 210. The pads 212 may be arranged in a predetermined array and configured to engage mating contacts or beams of another electrical connector that mates with the connector 100. In addition, the pads 212 are electrically connected through the circuit board 114 to corresponding vias 214. In some embodiments, the circuit board 114 includes traces (not shown) that extend through the circuit board in predetermined patterns that are configured to tune the transmission of signals through the connector 100. For example, the circuit board 114 may include non-ohmic plates, fingers, and the like that are configured to reduce return loss and/or compensate for offending crosstalk.

In alternative embodiments, the pads 212 (or the mating end 115) and the vias 214 are not directly connected through the circuit board 114. For example, the connector 100 may be configured like an RJ-45 jack where each via 214 is electrically coupled to another plated thru-hole within the circuit board 114, which, in turn, is coupled to a pin contact that engages a plug contact at a mating end. As such, the terminal blocks 140, 142, and 144 (FIG. 1) are not required to be mounted to a circuit board that also directly engages a mating connector. Furthermore, in other embodiments, the connector 100 does not include the circuit board 114 and may use, alternatively, a non-conductive electrical component or body configured to house conductive pathways that interconnect the terminal contacts 218 and the pads 212 (or other contacts configured to engage the mating connector). Accordingly, as used herein, an "electrical component" includes a circuit board and as well as other bodies formed from a non-conductive material that house conductive pathways.

Also shown in FIG. 3, the terminal block 142 includes a terminal base portion 230 and an organizer portion 232 having a body 234. The base portion 230 may be substantially rectangular and have a length $L_2$ that extends along the direction of longitudinal axis 290 and a width $W_2$ that extends along the direction of lateral axis 292. The width $W_2$ may be configured to reduce or optimize electrical coupling between adjacent conductors. In other words, the width $W_2$, as shown in FIG. 3, may be reduced to limit a length of the conductors in which the conductors are not in a preferred arrangement (e.g., twisted pair arrangement).

The base portion 230 is configured to be mounted to the circuit board 114 and to facilitate holding terminal contacts 218 in a predetermined orientation. As shown, the base portion 230 also has a mating side 235 that includes a plurality of contact slots 240A and 240B and shield slots 242. The contacts slots 240A and 240B are configured to support the terminal contacts 218 therein, and the shield slots 242 are configured to support shields 246 therein. When the terminal block 142 is fully assembled, the organizer portion 232 is stacked onto the mating side 235 of the base portion 230. As shown, the base portion 230 may include holes 248 along the mating side 235.

The contact slots 240A and 240B are located in predetermined positions with the base portion 230. More specifically, the contacts slots 240 are positioned so that the terminal contacts 218 may electrically engage with the vias 214. As such, in the illustrated embodiment, the contact slots 240A and 240B have a staggered relationship similar to the vias 214. The terminal contact 218 may be, for example, an insulation piercing contact (IPC). In other embodiments, the terminal contacts 218 may be an insulation displacement contact (IDC). Moreover, the terminal contacts 218 may include tails or pin portions 219. In the illustrated embodiment, the contact slots 240 extend entirely through a thickness $T_2$ of the base portion 230 so that the pin portions 219 of the terminal contacts 218 may be inserted into corresponding vias 214 to electrically and mechanically couple corresponding terminal contacts 218 and vias 214.

Figure 4:
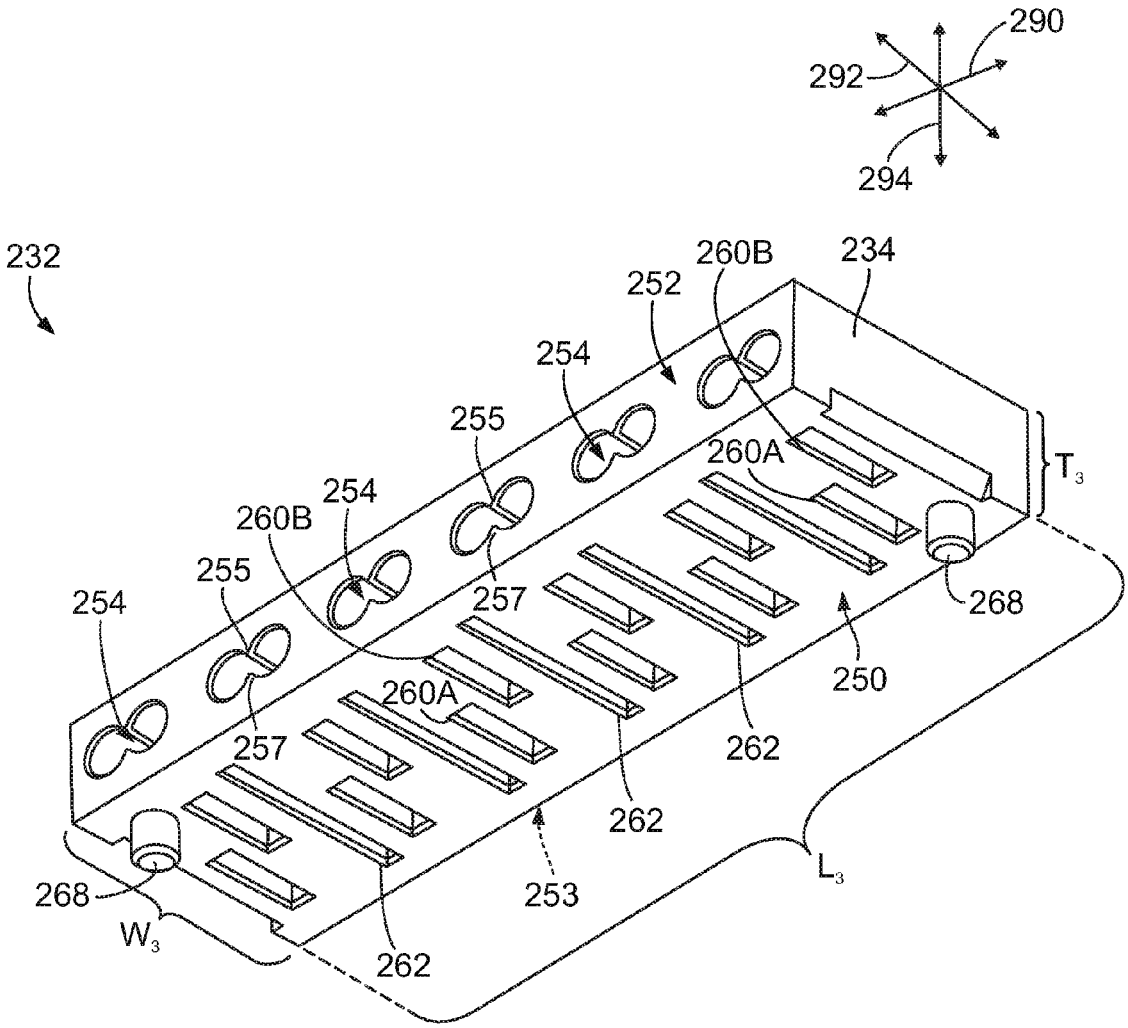
FIG. 4 is a perspective view of a mating side of an organizer portion that may be used with the terminal block shown in FIG. 3.

FIG. 4 illustrates the organizer portion 232 in greater detail. The body 234 of the organizer portion 232 has a length $L_3$ that extends along the direction of the longitudinal axis 290, a width $W_3$ that extends along the direction of the lateral axis 292, and a thickness $T_3$ that extends along the direction of the vertical axis 294. The organizer portion 232 includes opposite mating and distal sides 250 and 253 and a loading side 252. The mating side 250 is configured to engage the mating side 235 (FIG. 3) of the base portion 230 (FIG. 3) when the organizer portion 232 is stacked with respect to the base portion 230. The loading side 252 has a plurality of openings 254 that lead into corresponding channels 256 (shown in FIG. 5). The channels 256 may extend in an axial direction from the loading side 252 to the distal side 253. Each opening 254 may be configured to receive one or more conductors 276 (shown in FIG. 5) and lead into one or more channels 256. For example, each opening 254 shown in FIG. 4 has a pair of opposing protrusions 255 and 257 that are configured to hold separate two conductors 276 within a common channel 256. The two conductors 276 may be from one differential pair. The channels 256 may extend along the direction of the lateral axis 292 perpendicular to the longitudinal axis 290. In some embodiments, the channels 256 may extend substantially parallel to the board surface 208. Alternatively or in addition to, the channels 256 may extend substantially perpendicular to the slots 240. As shown, the organizer portion 232 may receive twelve total conductors 276. However, in alternative embodiment, the organizer portion 232 may receive more or less conductors 276.

The mating side 250 includes several openings 260 that lead into corresponding passages 270 (shown in FIG. 5). For instance, the mating side 250 has several pairs of openings 260A and 260B. The openings 260A and 260B are configured to have a similar spatial relationship as the vias 214 (FIG. 3). For example, the openings 260A and 260B may have a staggered relationship. Furthermore, the mating side 250 may have a plurality of openings 262 that lead into corresponding passages 272 (shown in FIG. 5). The passages 270 are sized and shaped to receive the terminal contacts 218 (FIG. 3) that project from the mating side 235 of the base portion 230, and the passages 272 are sized and shaped to receive the shields 246 (FIG. 3) from the base portion 230. Also shown, the mating side 250 may have guide posts 268 that project from the mating side 250 along the vertical axis 294. The guide posts 268 are sized and shaped to be received by the holes 248 (FIG. 3) of the base portion 230.

Figure 5A:
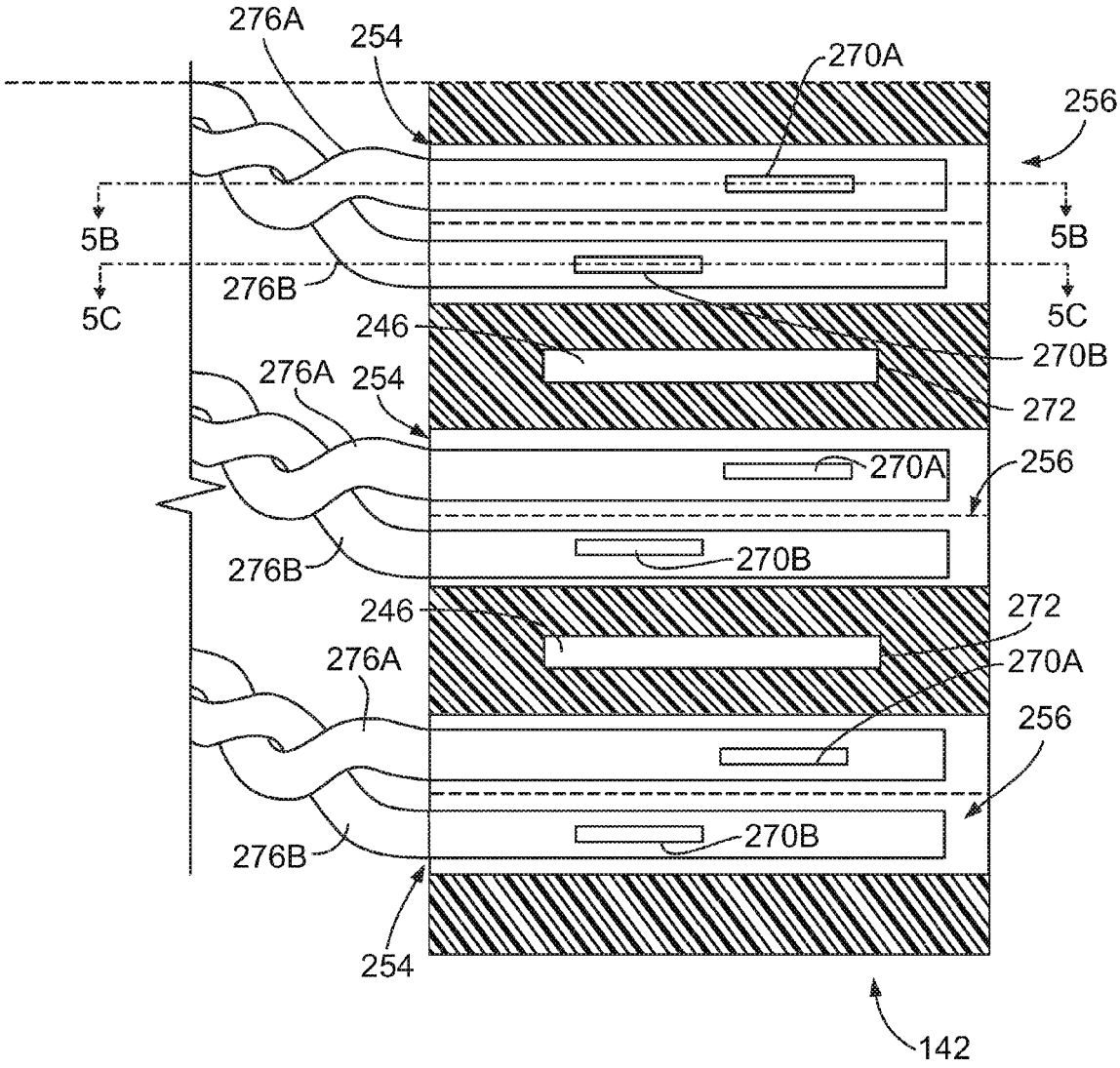
FIG. 5 is a cross-sectional view of the board assembly shown in FIG. 3 when conductors are electrically coupled within the terminal block.

FIG. 5A is a cross-sectional view of the terminal block 142 taken along a plane that is parallel to the axes 290 and 292 (FIG. 3) and intersects the channels 256. In the illustrated embodiment, the channels 256 are enclosed such that the conductors are surrounded by the body 234. The channels 256 may be co-planar with respect to each other (i.e., extend along a common plane) and/or oriented in a common direction. However, the channels 256 may not be co-planar and may be oriented in different directions in alternative embodiments.

Figure 5B:
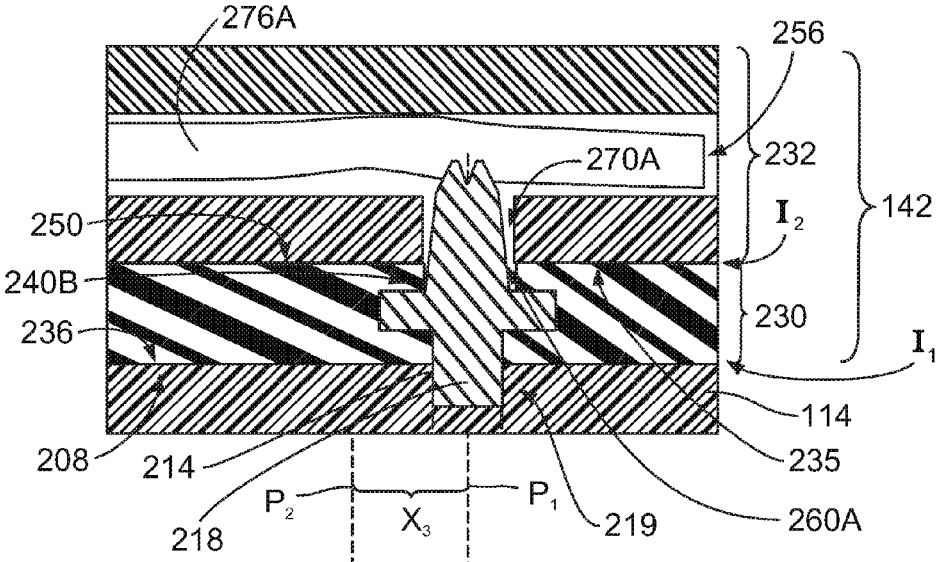
Figure 5C:
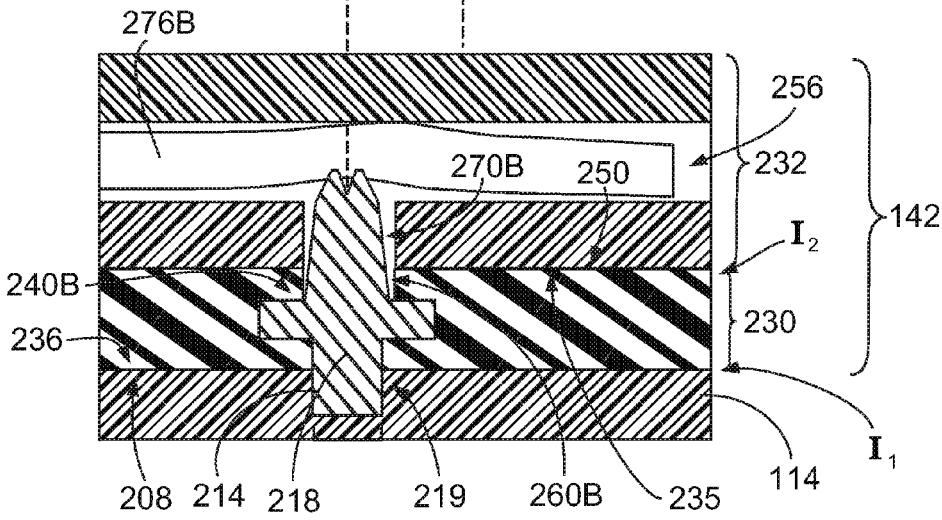

FIGS. 5B and 5C are cross-sections taken along a plane that extends along the axes 292 and 294 (FIG. 3). FIGS. 5B and 5C are through adjacent passages 270A and 270B, respectively, of one channel 256. The base portion 230 may have a mounting side 236 that is configured to be mounted on the board surface 208 of the circuit board 114. The contact slots 240 may extend from the mounting side 236 therethrough. When the base portion 230 is mounted on the board surface 208, the board surface 208 and the mounting side 236 extend along an interface $I_1$. In order to assemble the terminal block 142, the terminal contacts 218 and shields 246 may be inserted into the corresponding contact slots 240 and shield slots 242 (FIG. 4) within the base portion 230. The base portion 230 may then be mounted onto the circuit board 114 by inserting pin portions 219 of the terminal contacts 218 into corresponding vias 214. With respect to the organizer portion 232, the conductors 276 may be inserted into the openings 254 and advanced through the corresponding channels 256 for a predetermined length. With the terminal contacts 218 and shields 246 projecting from the mating side 235 of the base portion 230 as shown in FIG. 3, the organizer portion 232 may be mounted or stacked onto the base portion 230. The terminal contacts 218 advance into the corresponding passages 270 and electrically couple to the corresponding conductor 276.

However, in alternative embodiments, the terminal block 142 may be assembled by other methods. For example, the terminal contacts 218 and the shields 246 may first be inserted into the organizer portion 232 and then lowered onto the base portion 230 such that the terminal contacts 218 are inserted into the corresponding contacts slots 240 and the shields 246 are inserted into the corresponding shield slots 242.

As shown in FIGS. 5B and 5C, when the organizer portion 232 is engaged with the base portion 230, the mating sides 235 and 250 extend along an interface $I_2$. In some embodiments, the mating sides 235 and 250 are substantially planar. However, in other embodiments, the mating sides 235 and 250 may not be substantially planar and may (or may not) have complementary surfaces. Each contact slot 240A aligns with a corresponding opening 260A of a corresponding passage 270A, and each contact slot 240B aligns with a corresponding opening 260B of a corresponding passage 270B. The terminal contacts 218 advance through corresponding passages 270 when the organizer portion 232 and the base portion 230 are engaged. When the terminal contacts 218 reach the corresponding channels 256, the terminal contacts 218 electrically couple or engage with the corresponding conductor 276. For example, the terminal contact 218 may pierce or slice through a jacket of the conductor 276 and connect to a conductive core therein.

As shown, the terminal contact 218 within the passage 270A electrically couples to the conductor 276A approximately at a point $P_1$, and the terminal contact 218 within the passage 270B electrically couples to the conductor 276B approximately at a point $P_2$. The points $P_1$ and $P_2$ are separated from each other by the longitudinal distance $Y_1$ and by a lateral distance $X_3$. (The lateral distance $X_3$ is approximately equal to a difference between lateral distances $X_1$ and $X_2$ shown in FIG. 3.) Accordingly, two conductors 276 of one differential pair may be engaged at separate axial locations within one channel 256. Separating the points $P_1$ and $P_2$ may facilitate improving the performance of the connector 100 (FIG. 1).

Furthermore, in the illustrated embodiment, the shields 246 are located within the passages 272. The passages 272 extend between adjacent conductors 276 from separate differential pairs. The shield 246 may be sized and shaped to improve the performance of the connector 100. For example, the shields 246 may be configured to reduce electromagnetic coupling between adjacent conductors 276 and/or to dissipate heat generated by the conductors 276 within the channels 256. Accordingly, the distances $X_3$ and $Y_1$ and the shields 246 may be configured for a desired performance.

Figure 6:
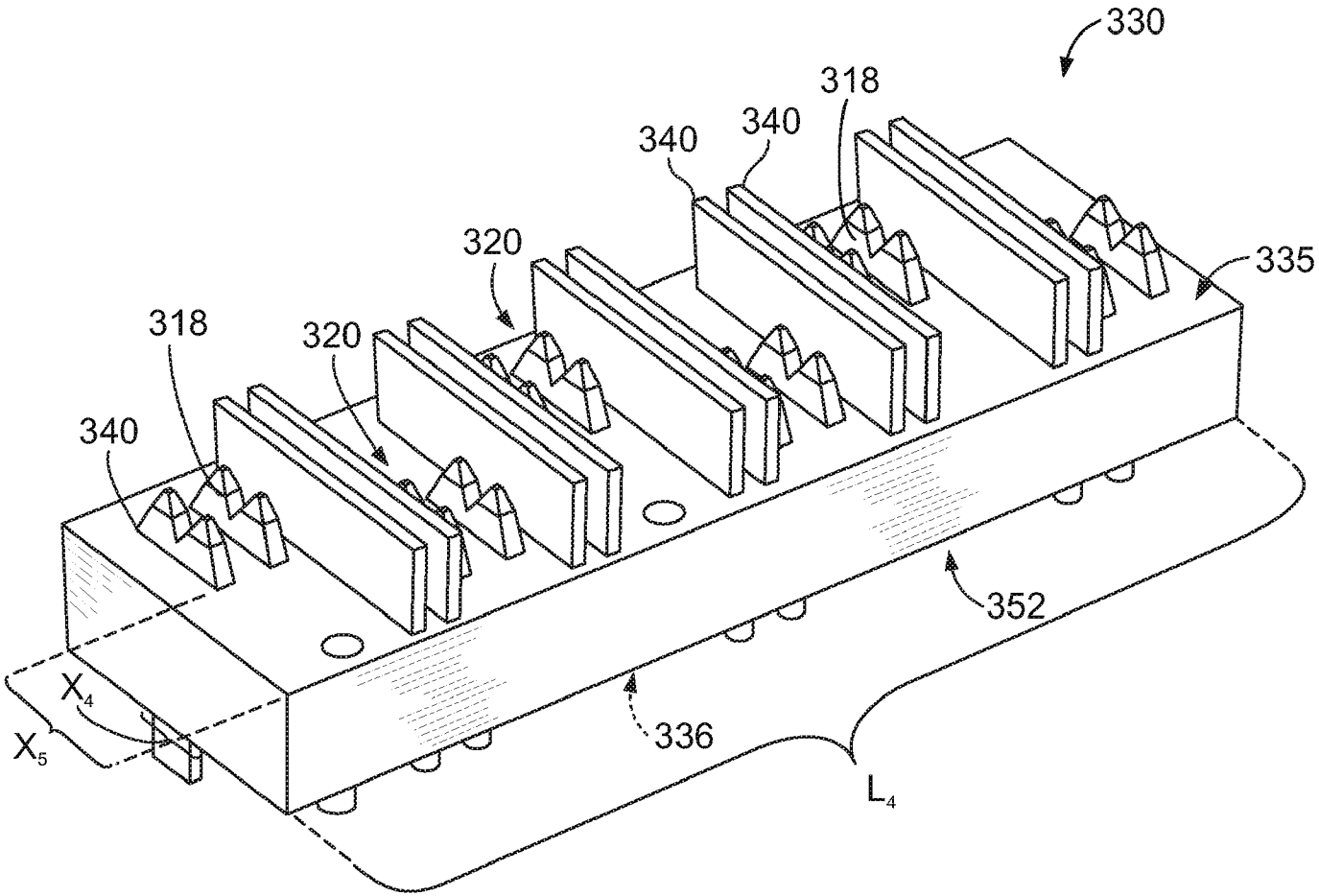
FIG. 6 is a perspective view of a terminal base portion formed in accordance with another embodiment.
Figure 7:
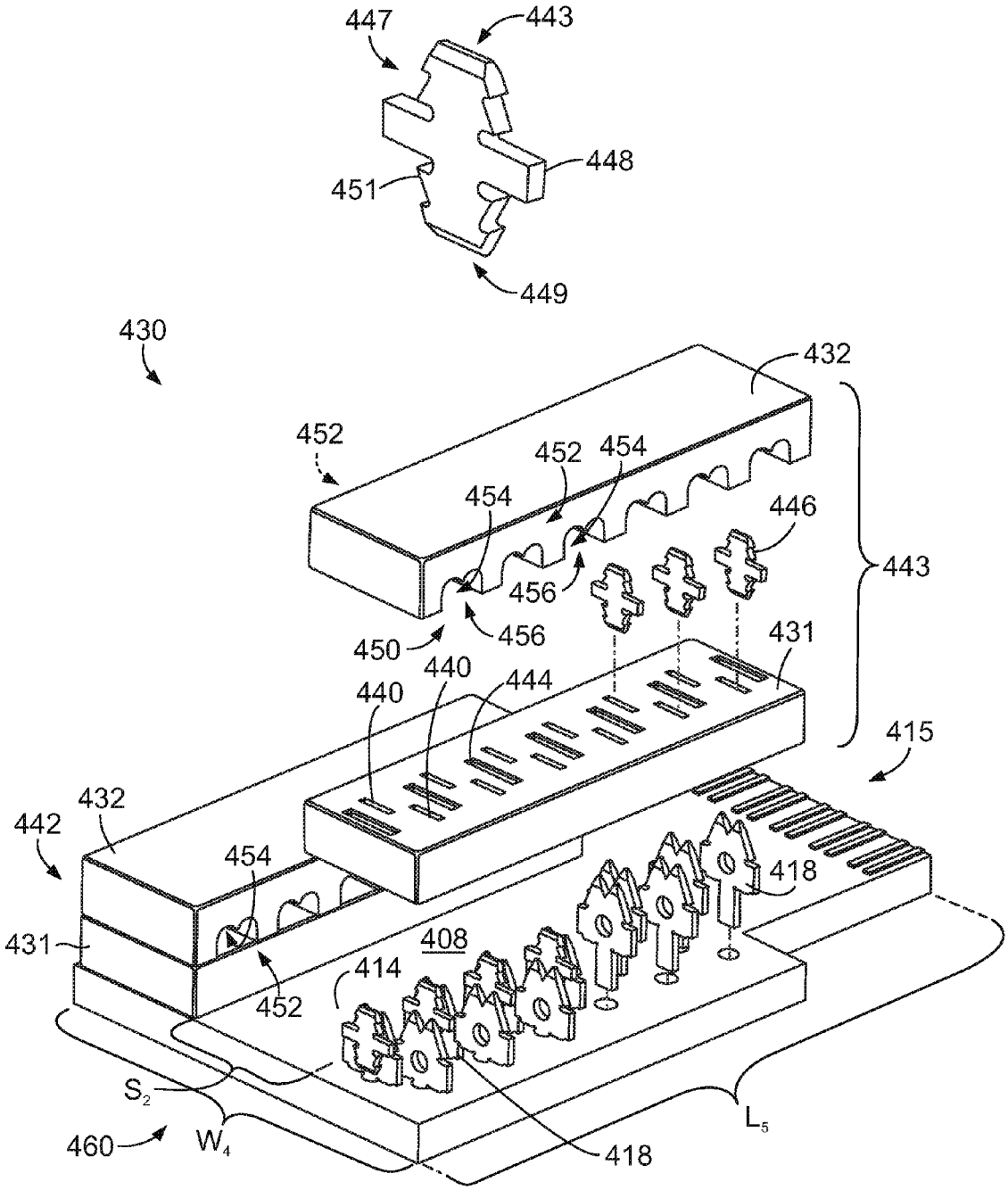
FIG. 7 is a perspective view of a board assembly formed in accordance with an alternative embodiment.
Figure 8:
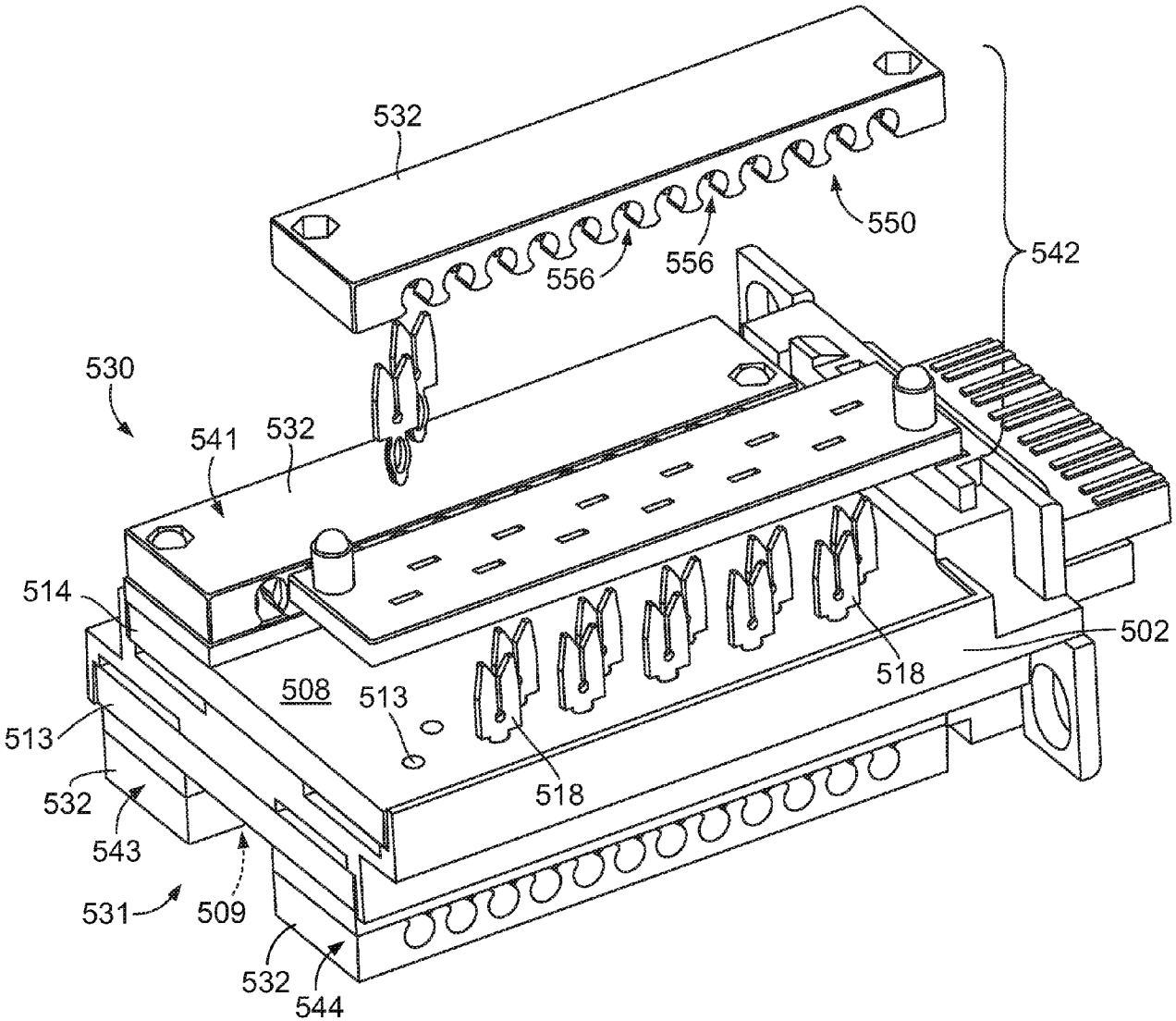
FIG. 8 is a perspective view of a pair of board assemblies formed in accordance with alternative embodiments.

FIGS. 6-8 illustrate alternative embodiments of terminal blocks and board assemblies. FIG. 6 is a perspective view of a terminal base portion 330. The base portion 330 has a mating side 335 and a mounting side 336 that is configured to be mounted onto a board surface of a circuit board (not shown). The base portion 330 also includes pairs 320 of contact slots 340 that are configured to hold terminal contacts 318. The contact slots 340 of each pair 320 are aligned with one another side-by-side (i.e., each contact slot 340 of one pair 320 is a common distance $X_4$ or $X_5$ away from a loading side 352 of the base portion 330). As such, the pairs 320 of the contact slots 340 are staggered along a length $L_4$ of the base portion 330.

Also shown in FIG. 6, each pair of terminal contacts 318 may be separated by two shields 346. The shields 346 are sized and shaped to prevent electrical interference between adjacent pairs of terminal contacts 318. As shown, the terminal contacts 318 are similar to the terminal contacts 218, and the shields 346 are similar to the shields 246. However, other terminal contacts and shields may be used. Furthermore, although not shown, an organizer portion may have channels with or without passages leading into the channels that align with the terminal contacts when the organizer portion is mounted onto the base portion.

FIG. 7 is a perspective view of a board assembly 430 formed in accordance with an alternative embodiment. The board assembly 430 may have similar features as described above with respect to the board assembly 130. For example, the board assembly 430 has a loading end 460, a mating end 415, and a length $L_5$ of a circuit board 414 extending therebetween. Furthermore, the board assembly 430 may include a pair of terminal blocks 442 and 443 that are mounted onto a board surface 408 of the circuit board 414. The terminal blocks 442 and 443 may each include a terminal base portion 431 and an organizer portion 432 that facilitate electrically coupling terminal contacts 418 to conductors (not shown). The base portion 431 may have contact slots 440 and shield slots 444 configured to hold the terminal contacts 418 and shields 446, respectively.

However, as shown in FIG. 7, the organizer portion 432 may include a mating side 450 that has open-sided channels 456 extending therealong. The open-sided channels 456 may be configured to receive two conductors, such as two conductors from a differential pair. The organizer portion 432 also includes a loading side 452 having openings 454 therealong. In the illustrated embodiment, the open-sided channels 456 are configured for an interference fit with the corresponding conductors.

Also shown in FIG. 7, the shields 446 may be substantially cross-shaped and configured for an interference fit with the shield slots 444 and corresponding passages (not shown) within the organizer portion 432. More specifically, the shield 446 may include a laterally oriented base 448 and a pair of vertically oriented retention features 447 and 449. The retention features 447 and 449 may extend away from the base 448 in opposite directions with respect to each other. Also, the retention features 447 and 449 may extend substantially perpendicular to the base 448. As shown, the retention features 447 and 449 may be shaped to form interference fits with the base and organizer portions 431 and 432. For example, the retention features 447 and 449 may include barbs 451 that project laterally away from the corresponding retention feature 447 or 449. As such, the shields 446 may facilitate shielding and/or dissipating heat generated by the conductors and may also facilitate securing the base and organizer portions 431 and 432 together.

Also shown, when the terminal block 442 is fully assembled, the loading side 452 of each terminal block 443 and 442 may be separated by and face each other across a spacing $S_2$ along a width $W_4$ of the board assembly 430. The spacing $S_2$ is sized so that a plurality of twisted pairs of conductors (not shown) may fit between the terminal blocks 443 and 442. In particular, the spacing $S_2$ may be sized so that numerous differential pairs may be received along the board surface 408 of the circuit board 414. The conductors may extend lengthwise along the circuit board 414 and then bend into the corresponding openings 454 along the loading sides 452. Accordingly, the board assembly 430 may be configured to receive numerous differential pairs and electrical engage the corresponding conductors to the circuit board 414.

FIG. 8 illustrates a pair of board assemblies 530 and 531 that are coupled together by a board frame 502. The board assemblies 530 and 531 may have similar or identical elements and features and include circuit boards 514 and 513, respectively, with respective board surfaces 508 and 509. However, the board surfaces 508 and 509 may face away from each other in opposite directions. The board assembly 530 includes terminal blocks 541 and 542, and the board assembly 531 includes terminal blocks 543 and 544. Each terminal block 541-544 includes an organizer portion 532 that has open-sided channels 556 extending along a mating side 550 of the organizer portion. Each open-sided channel 556 may be configured for an interference fit with a corresponding conductor (not shown). As such, the organizer portion 532 can hold conductors therein during the assembly of the corresponding terminal block and the board assemblies 530 and 531 such that the conductors do not inadvertently fall out of the channels 556.

Each terminal block 541-544 may electrically couple twelve conductors (not shown) to corresponding terminal contacts 518. The terminal contacts 518 are shown as IDC's in FIG. 8 having eye-of-needle contacts that form an interference fit with corresponding vias 517. In the illustrated embodiment, the terminal contacts 518 are staggered with respect to each other and do not have a shield therebetween. Accordingly, the board assemblies 530 and 531 may be coupled together by the board frame 502 and inserted into an interior of a connector housing (not shown). The coupled board assemblies 530 and 531 may electrically interconnect, for example, forty-eight (48) conductors from a cable.

Figure 9:
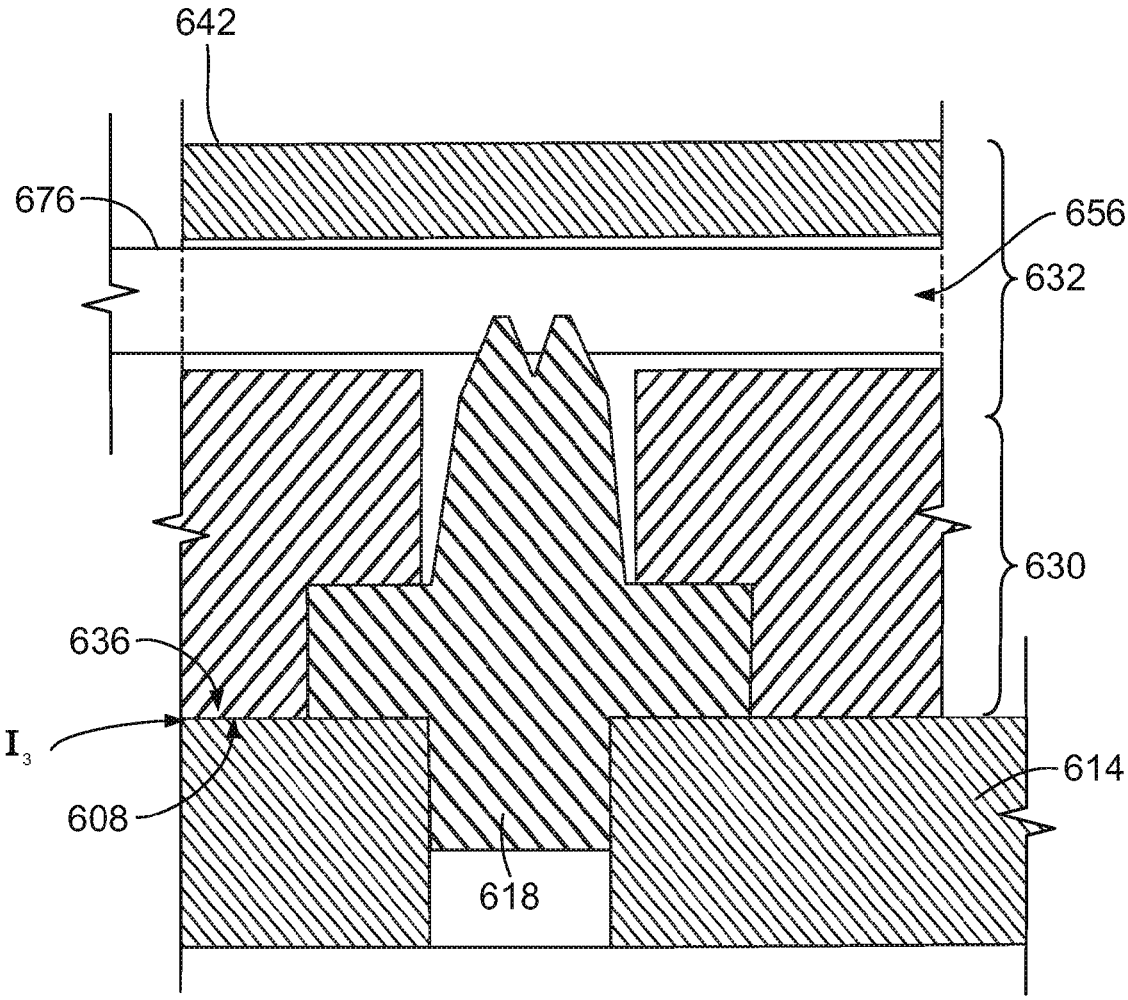
FIG. 9 is a cross-sectional view of a terminal block formed in accordance with another embodiment.

In addition, many modifications may be made to adapt a particular situation or material to the teachings of the invention without departing from its scope. For example, although FIGS. 3-8 show terminal blocks as being constructed by separate base portions and organizer portions, embodiments may include terminal blocks that are integrally formed with the features of the base portions and organizer portions described above. FIG. 9 illustrates such an example and, more particularly, a cross-section that is similar to the cross-sections shown in FIGS. 5B and 5C, except without the interface $I_2$. As shown, a base portion 630 and organizer portion 632 may be integrally formed into a terminal block 642 (e.g., through an injection molding process). As such, the base portion 630 is positioned between the organizer portion 632 and a circuit board 614, and the organizer portion 632 extends away from the base portion 630 and the circuit board 614.

As shown in FIG. 9, a terminal contact 618 may be inserted through the bottom of the terminal block (i.e., through a mounting side 636 that eventually forms an interface $I_3$ with a board surface 608 of the circuit board 614). Conductors 676 may be inserted into channels 656 before the terminal block 642 is interfaced with the circuit board 614 along the interface $I_3$ and before the terminal contacts 618 are inserted into the terminal block 642. After the conductors 676 are inserted into the channels 656, the integrally formed terminal block 642 may be mounted on the board surface 608. Accordingly, a "base portion" and an "organizer portion" may be portions of a terminal block having one integrally formed body or may be separate components. Also, although not shown, the terminal block 642 may include shield slots configured to form an interference fit with shields. The shields may be inserted into the terminal block 642 through the mounting side 636 or any other side of the terminal block 642.

In other alternative embodiments, the base portions and the organizer portions may be integrally formed with other components of the connector. For example, the organizer portion 232 of FIG. 3 may be integrally formed with the housing shell 120 (FIG. 1). Furthermore, in alternative embodiments where the circuit board 114 is substituted with a plastic electrical component that houses conductive pathways, the base portion 230 may be integrally formed with the plastic component.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A terminal block for electrically coupling conductors and terminal contacts, the terminal block comprising:

a terminal base portion having a mounting side configured to be mounted to a surface of an electrical component, the base portion having contact slots extending from the mounting side therethrough, the contact slots being configured to receive terminal contacts that are electrically coupled to the electrical component; and an organizer portion extending from the base portion and comprising channels extending substantially parallel to the surface of the electrical component, the channels configured to receive corresponding conductors, wherein the contact slots of the base portion align with corresponding channels of the organizer portion so that the terminal contacts electrically couple to the conductors;

wherein each channel extends along an axis between a loading side and an opposite distal side of the organizer portion, wherein adjacent contact slots of the base portion have different axial positions so that the terminal contacts electrically couple to the conductors at different axial positions along the axis.

2. The terminal block of claim 1 wherein the base and organizer portions are separate components having respective mating sides, the mating sides of the base and organizer portions configured to engage each other along an interface such that the contact slots are aligned with the corresponding channels.

3. The terminal block in accordance with claim 2 wherein the channels are open-sided channels that open towards the mating side of the base portion.

4. The terminal block in accordance with claim 2 wherein the channels are enclosed channels configured to hold the conductors therein, the organizer portion having passages that extend from the mating side and into corresponding channels, the passages configured to receive the terminal contacts from the base portion.

5. The terminal block in accordance with claim 1 wherein each channel is configured to hold multiple conductors.

6. The terminal block in accordance with claim 1 wherein the channels extend along a common plane.

7. The terminal block in accordance with claim 1 further comprising the terminal contacts.

8. A terminal block for electrically coupling conductors and terminal contacts, the terminal block comprising:

a terminal base portion having a mounting side configured to be mounted to a surface of an electrical component, the base portion having contact slots extending from the mounting side therethrough, the contact slots being configured to receive terminal contacts that are electrically coupled to the electrical component; and an organizer portion extending from the base portion and comprising channels extending substantially parallel to the surface of the electrical component, the channels configured to receive corresponding conductors, wherein the contact slots of the base portion align with corresponding channels of the organizer portion so that the terminal contacts electrically couple to the conductors, wherein the organizer portion further comprises a passage located between adjacent channels and configured to hold a shield therein.

9. A board assembly for an electrical connector or device:

a circuit board having a surface;

terminal contacts electrically coupled to the circuit board; and a terminal block mounted on the surface of the circuit board, the terminal block comprising:

a terminal base portion having a mounting side configured to be mounted to the surface of the circuit board, the base portion having contact slots extending from the mounting side therethrough, the contact slots being configured to receive the terminal contacts that are electrically engaged to the circuit board; and an organizer portion comprising channels extending substantially parallel to the surface of the circuit board, the channels configured to receive corresponding conductors, wherein the contact slots of the base portion align with corresponding channels of the organizer portion so that the terminal contacts electrically engage the conductors;

wherein each channel extends along an axis between a loading side and an opposite distal side of the organizer portion, wherein adjacent contact slots of the base portion have different axial positions so that the terminal contacts electrically couple to the conductors at different axial positions along the axis.

10. The board assembly of claim 9 wherein the base and organizer portions are separate components having corresponding mating sides, the mating sides of the base and organizer portions configured to engage each other along an interface such that the contact slots are aligned with the corresponding channels.

11. The board assembly in accordance with claim 9 wherein the channels extend along a common plane.

12. The board assembly in accordance with claim 10 wherein the organizer portion further comprises passages that extend from the mating side of the body and into a corresponding channel, each passage configured to receive the terminal contact that is configured to electrically engage the conductor within the corresponding channel.

13. The board assembly in accordance with claim 12 wherein the passages of adjacent channels have different axial positions with respect to each other.

14. The board assembly in accordance with claim 9 wherein the terminal block is a first terminal block and the board assembly further comprises a second terminal block mounted onto a common board surface of the circuit board, the first and second terminal blocks being separated by a spacing along the circuit board, the loading sides of the first and second terminal blocks facing each other across the spacing.

15. The board assembly in accordance with claim 9 further comprising shields located between adjacent channels, each shield including a laterally oriented base and first and second vertically oriented retention features, the first and second retention features extending away from the base in opposite directions with respect to each other and substantially perpendicular to the base, the first and second retention features being shaped to form interference fits with the base and organizer portions, respectively.

16. The board assembly in accordance with claim 9 wherein the circuit board has a mating edge configured to be inserted into a mating connector.

17. A board assembly for an electrical connector or device, the board assembly comprising:

a circuit board;

terminal contacts electrically coupled to the circuit board; and a pair of terminal blocks including the terminal contacts, the pair of terminal blocks being mounted onto a common board surface of the circuit board, the terminal blocks being separated by a spacing, each terminal block comprising a loading side having openings to channels extending into the terminal block, the channels being configured to receive conductors, the loading sides of the terminal blocks facing each other across the spacing wherein each terminal block comprises:

a terminal base portion having a mounting side configured to be mounted to the surface of the circuit board, the base portion having contact slots extending from the mounting side therethrough, the contact slots being configured to receive terminal contacts that are electrically engaged to the circuit board; and an organizer portion comprising the channels, the channels extending substantially parallel to the surface of the circuit board, wherein the contact slots of the base portion align with corresponding channels of the organizer portion so that the terminal contacts electrically engage the conductors.

18. The board assembly in accordance with claim 17 wherein the channels of each terminal block extend substantially perpendicular to a longitudinal axis that extends along the loading sides.

19. The board assembly in accordance with claim 17, wherein each terminal block is configured to receive numerous conductors.

20. The board assembly in accordance with claim 17, wherein each channel extends along an axis between the loading side and an opposite distal side of the terminal block, wherein adjacent contact slots of the base portion have different axial positions so that the terminal contacts electrically couple to the conductors at different axial positions along the axis.

* * * * *